US005084600A

United States Patent [19]

Seki et al.

[11] Patent Number: 5,084,600

[45] Date of Patent: Jan. 28, 1992

[54] GAS-BLAST LOAD-BREAK SWITCH

[75] Inventors: Takahide Seki; Syunji Itou; Haruo Honda; Tohru Tsubaki, all of Hitachi, Japan

[73] Assignee: Hitachi, Ltd., Tokyo, Japan

[21] Appl. No.: 618,465

[22] Filed: Nov. 27, 1990

[51] Int. Cl.[5] ..... H01H 33/82

[52] U.S. Cl. ..... 200/148 R; 200/148 B

[58] Field of Search ..... 200/148 A, 148 B, 148 R

[56] References Cited

U.S. PATENT DOCUMENTS 4,511,776 4/1985 Romier et al. ..... 200/148 A

*Primary Examiner*—Harold Broome

*Attorney, Agent, or Firm*—Antonelli, Terry, Stout & Kraus

[57] ABSTRACT

A gas-blast load-break switch comprises a pressure storage chamber for storing pressure of arc-extinguishing gas with arc energy generated by the disconnection between contacts, and a suction chamber including a piston which is moved in connection with the cut-off movement of the movable contact. A gas flowing device is provided such that the pressure raised by the arc energy is stored in the pressure storage chamber before communicating the pressure storage chamber and the suction chamber and a gas chamber formed on the opposite side of the piston from the suction chamber. The volume of the gas chamber is greater than that of the pressure storage chamber and the suction chamber, and the distance of piston movement in the suction chamber is longer than the contact length when the movable contact is thrown into the fixed contact.

7 Claims, 5 Drawing Sheets

GAS-BLAST LOAD-BREAK SWITCH

BACKGROUND OF THE INVENTION

The present invention relates to a gas-blast load-break switch and, more particularly, to a breaker switch including a negative pressure generating apparatus for forming blasting gas flow against an arc.

A conventional gas-blast load-break switch of disclosed in, for example, U.S. Pat. No. 4,511,776, comprises a sealed container containing arc extinguishing fluid such as $SF_6$ gas or the like and disconnectable fixed and contacts, with a pressure storage device including a pressure storage chamber for raising the pressure of arc extinguishing fluid using the arc energy generated by the separation of those contacts and with a negative pressure generating device including a negative pressure chamber generating negative pressure by the relative movement between a cylinder and a piston caused by the separating operation of the movable contact. With the above described construction, the arc between the detached contacts will be extinguished by a blasting of gas flow directed from the pressure storage chamber to the negative pressure chamber, which gas flow is caused by the differential pressure between the initial pressure and rising pressure caused by the arc energy in the pressure storage chamber and the negative pressure in the negative pressure chamber.

In the abovementioned prior art, the contact length L is predetermined between the movable contact and the fixed contact when the movable contact is thrown into the fixed contact, with the length L being equal to the length of the piston movement defining the negative pressure chamber. Consequently, the movable contact moves by the distance L relative to the fixed contact during the breaking operation of the movable contact, the movable contact begins to be detached from the fixed contact and, at the same time, the negative pressure chamber initiates to communicate with the gas chamber located on the other side of the negative chamber from the piston. Subsequently, the negative pressure chamber immediately communicates with the gas chamber on the other side thereof from the piston.

In this case, therefore, the pressure by the arc energy cannot be satisfactorily raised to achieve a complete extinguishing of the arc. For example, when an electric current of approximately 100 to 500 ampere is applied between the contacts, as the electric current being relatively lower, the arc is extinguished by merely the differential pressure between the initial pressure in the pressure storage chamber and the negative pressure in the negative pressure chamber. Further, when a higher electric current is applied between the contacts, the rising pressure caused by the arc energy in the pressure storage chamber instantly risen because the arc energy is generated in proportion to the higher current, thereby extinguishing the arc. However, for example, when the contacts are subjected to an high-intensity electric current to approximately 1000 to 3000 ampere, the rising pressure produced by the arc energy in the pressure storage chamber is not sufficient. Therefore, a problem arises in that the arc generated between the contacts cannot be extinguished by the insufficient differential pressure between the initial pressure and rising pressure caused by the arc energy in the pressure storage chamber and the negative pressure in the negative pressure chamber.

Furthermore, according to the abovementioned prior art, the volume of the gas chamber on the opposite side of the piston from the negative pressure chamber is smaller than that of the pressure storage chamber and the negative pressure chamber, which gas chamber is filled up with the heated fluid after extinguishing the arc. As a result, a further problem arises in that the temperature of the arc extinguishing fluid in the gas chamber is raised to an extent that insulating capacity of the arc extinguishing fluid itself is remarkably deteriorated and loses its insulating ability.

SUMMARY OF THE INVENTION

An object of the present invention is to provide a gas-blast load-break switch which can positively extinguish the discharge current arc, of a lower or higher intensity, and which has an excellent insulating capacity.

In order to achieve the abovementioned object, a gas-blast load-break switch according to the present invention comprises a sealed container filled with arc extinguishing gas, a fixed contact and a movable contact detachable from each other, with both contacts being disposed within the sealed container. A pressure storage chamber includes an insulating nozzle with a throat portion through which the movable contact is inserted thereinto and contains therein a contact portion between the both contacts. A suction chamber is formed on the opposite side of the insulating nozzle from the pressure storage chamber and includes a piston connected to the movable contacts, with a space being formed not only as a housing for an operation lever which drives the movable contact, but also as a gas chamber, on the opposite side of the piston from the suction chamber within the sealed container. The volume of the gas chamber is greater than that of the pressure storage chamber and the suction chamber and a gas flowing means is provided for communicating the suction chamber and the gas chamber and interrupting the gas flow between both chambers during the movement of the piston. The gas flowing means is provided on an inner surface of the sealed container adjacent to the suction chamber and a distance of the piston movement in the suction chamber is longer than the contact length when the movable contact is thrown into the fixed contact.

Due to the abovementioned arrangement, when the movable contact is separated from the fixed contact, the communication between the suction chamber and the gas chamber defined on the opposite side of the piston from the suction chamber is interrupted thereby enabling an increase in pressure generated by the arc energy to accumulate in the pressure storage chamber. As a result, when the gas flowing means communicates the suction chamber and the gas chamber located on opposite side of the piston from the suction chamber during the piston movement, the increasing pressure by the arc energy can favorably be activated to positively extinguish the arc. Also, because the volume of the gas chamber is relatively large, the temperature of the heated arc extinguishing gas introduced into the gas chamber can be lowered, contributing to maintaining the insulating capacity.

Other objects, characteristics and advantages of the present invention will be fully explained hereinafter with reference to the accompanying drawings.

DETAILED DESCRIPTION OF THE PREFERRED EMBODIMENTS

One embodiment of the present invnetion will be described hereinafter with reference to the drawings.

Figure 1:
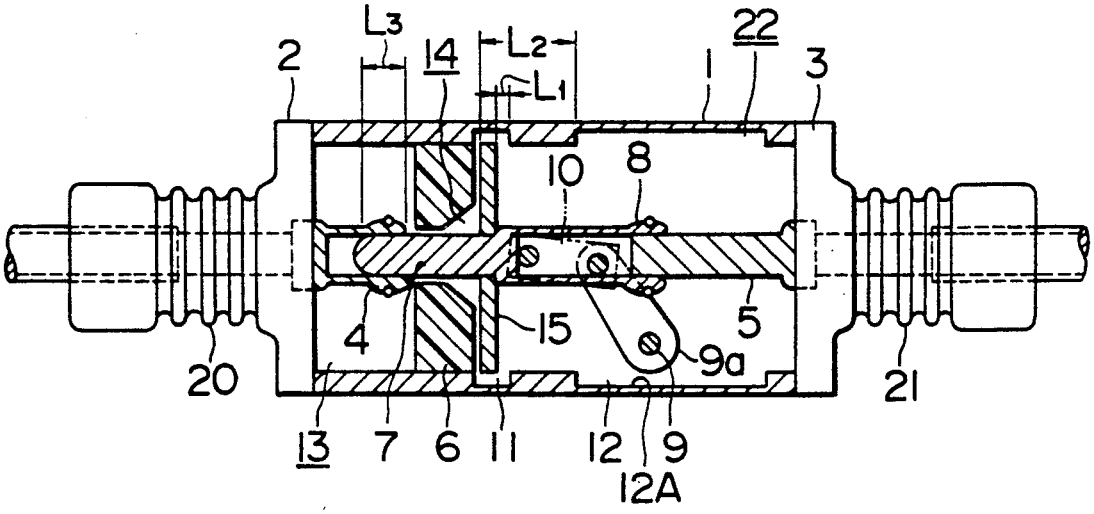
FIG. 1 is a vertically cross-sectional front view of a cut-off breaker, in a closed position, of a gas-blast load-break switch according to one embodiment of the present invention.

Referring now to the drawings wherein like reference numerals are used throughout the various views to designate like parts and, more particularly, to FIG. 1, according to this figure, one end of a cylindrical sealed container 1 of the cut-off beaker is airtightly closed by a terminal end plate 2 and a bushing 20, and the other end is also airtightly closed by a terminal end plate 3 and a bushing 21. The container 1 is filled with arc-extinguishing gas such as $FS_6$ or the like. A fixed contact 4 is securely connected on an inner surface of one terminal end plate 2 within the cut-off breaker of the sealed container 1, and a fixed conductor 5 is securely connected on an inner surface of the other terminal end plate 3 within the sealed container 1 of the cut-off breaker. A movable contact 7, including a current collector 8 always in contact with the fixed conductor 5, contacts the fixed contact 4. Accordingly, on a center axis of the sealed container 1, the fixed contact 4, the movable contact 7, the current collector 8 and the fixed conductor 5 are disposed in alignment between the terminal end plates 2 and 3. The fixed conductor 5 is slidably fitted in a groove formed at the central portion of the current collector 8. A lever **9*a* is connected to the movable contact 7 via a link 10 of an insulating material with the lever 9*a* being connected to an operation system (not shown) by a common driving shaft 9**.

Fixed on an inner surface of the sealed container 1 of the cut-off breaker is an insulating nozzle 6 which divides the inner space of the closed container 1 into a pressure storage chamber 13 on one side of the nozzle containing a contact portion between both contacts 4 and 7 and a suction chamber 14 located on the opposite side thereof. The suction chamber 14 is defined by a surface on one side of a piston 15 connected to the movable contact 7 and a surface of the insulating nozzle 6 opposite to the surface of the piston. A gas chamber 22 is formed on the other side of the piston 15 from the suction chamber 14. The gas chamber 22 receives therein a system of connecting mechanism of the movable contact 7 comprising the link 10 and the lever **9*a* as well as a current collector ring mechanism section such as the current collector 8 and the like for electrically connecting the fixed conductor 5 and the movable contact 7. The volume of the gas chamber 22 is larger than that of the pressure storage chamber 13 and the suction chamber 14, so that the temperature of heated gas introduced into the gas chamber 22 will be easily lowered so as to maintain favorable insulating capacity. The inner surface of the sealed container 1 in the cut-off breaker which slidingly contacts with the outer periphery of the piston 15 is formed with a recessed portion which serves as a first gas flowing means 11, communicating the suction chamber 14 and the gas chamber 22 at the closed condition illustrated in the drawings and also in the beginning of breaking operation. This gas flowing means 11 maintains communicating between the suction chamber 14 and the gas chamber 22 only when the piston 15 moves the distance $L_1$ in a direction of breaking the circuit. The inner surface of the sealed container 1 of the cut-off breaker at the right hand side of the first gas flowing means is formed with a sliding surface which is brought into closed contact with the outer periphery of the piston 15. Continuous to the sliding surface, there is on the inner surface of the container a second gas flowing means 12 which is formed with an enlarged portion 12A communicating the suction chamber 14 and the gas chamber 22. The second gas flowing means 12 becomes functional when the piston 15 moves for breaking operation by the distance $L_2$ from the initial switch-closed position shown in FIG. 1. It is distinguished from the above-described first gas flowing means 11 which shuts off from communication between both chambers during the breaking operation for a length from the end portion of the first gas flowing means, i.e., the end of the distance $L_1$ to the terminal portion of the sliding surface, i.e., the end of the distance $L_2$. The working distance $L_2$ of the second gas flowing means 12 is larger than the contact length $L_3$ between both contacts which is obtained when the movable contact 7 is thrown into the fixed contact 4. As a result, the rising pressure caused by arc energy will be stored within the pressure storage chamber 13**.

The difference between the first gas flowing means and the second gas flowing means will be further described with reference to FIGS. 3 to 6 illustrating some stages in the breaking operations.

Figure 3:
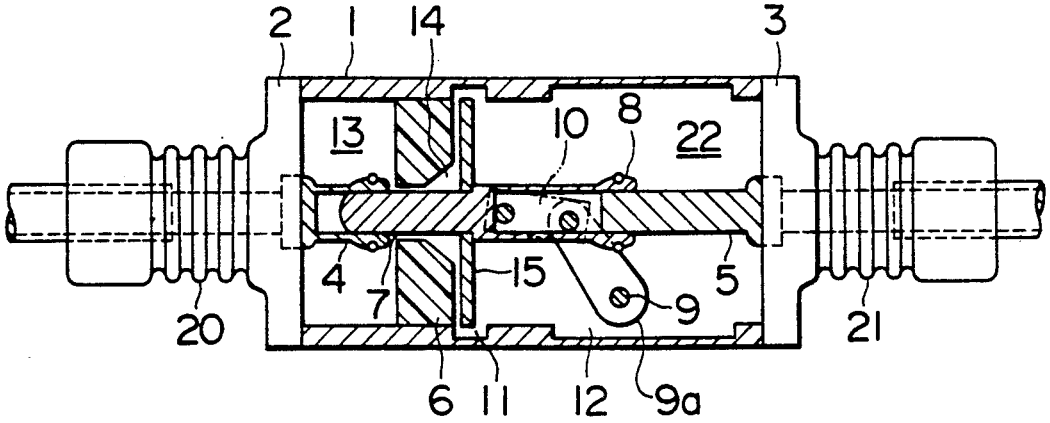
FIGS. 3 to 6 are cross-sectional views illustrative of different stages in breaking operations of the cut-off breaker of FIG. 1, respectively.

FIG. 3 shows a closed condition of the cut-off breaker, with the fixed contact 4 being in contact with the movable contact 7 within the pressure storage chamber 13, while the suction chamber 14 communicates with the gas chamber 22 through the first gas flowing means 11 formed between the inner surface of the sealed container 1 of the cut-off breaker and the outer periphery of the piston 15. The route of current is established between the bushing 20, the terminal end plate 2, the fixed contact 4, the movable contact 7, the current collector 8, the fixed conductor 5, the terminal end plate 3, and the bushing 21, and the remaining routes other than the current route are electrically insulated by an ordinal way.

Figure 4:
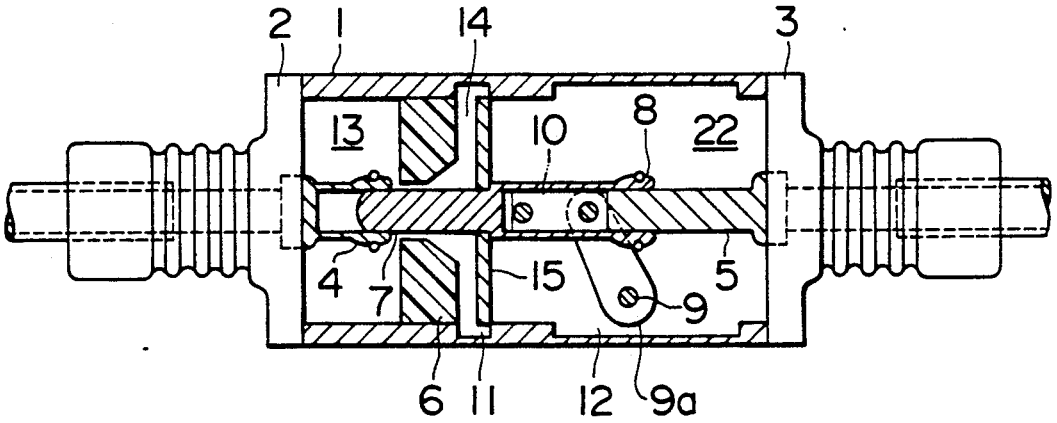

When the driving shaft 9 is rotated clockwise by an operating device (not shown) in response to a breaking command signal, the movable contact 7 is driven rightwardly by the actuation of the lever **9*a* and the like 10, as shown in FIG. 4. In this case, the volume of the suction chamber 14 becomes larger, however, it does not cause negative pressure because the first gas flowing means 11 communicates the suction chamber and the gas chamber 22. Therefore, in the beginning of the breaking operation, the suction chamber 14 does not create reaction force against the movement of the operation device, so that the size of the device can be made smaller. However, when the piston 15 moves the distance $L_1$ to reach the position of FIG. 4, the first gas flowing means 11 is blocked, thereby generating negative pressure in the suction chamber 14, and proceeding to the state in FIG. 5**.

Figure 5:
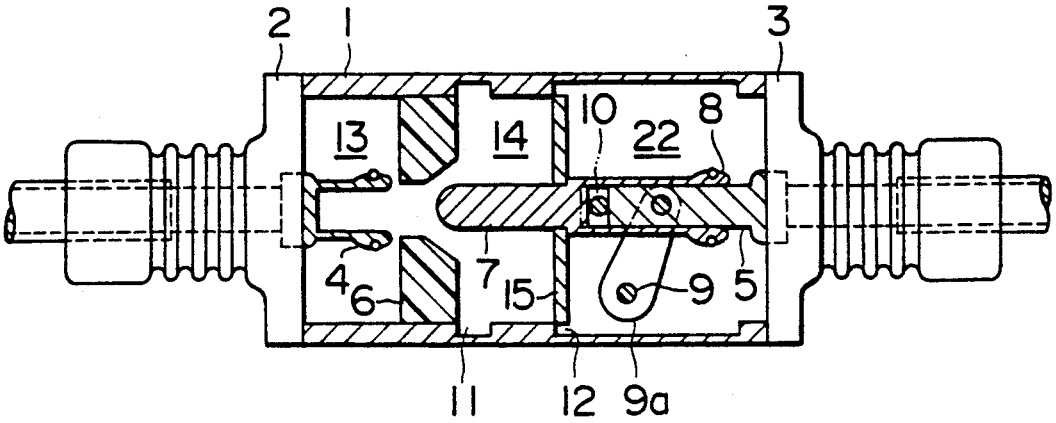

Before it reaches the position as shown in FIG. 5 (a state when the piston 15 has moved the distance $L_2$), the movable contact 7 is separated from the fixed contact 4, causing the rise of gas pressure in the pressure storage chamber 13 due to the generated arc. When the movable contact 7 comes out of the throat portion of the insulating nozzle 6, a gas flow is directed from the pressure storage chamber 13 through the suction chamber 14, with the arc being blasted by this gas flow. If the breaking-current is small, the arc is extinguished by the blasting, however, if the breaking-current is large, the pressure of the suction chamber 14 is immediately increased to a maximum level due to the gas flow accelerated by the arc energy from the storage 13. For the reason, the blasting cannot be satisfactorily continued.

Figure 6:
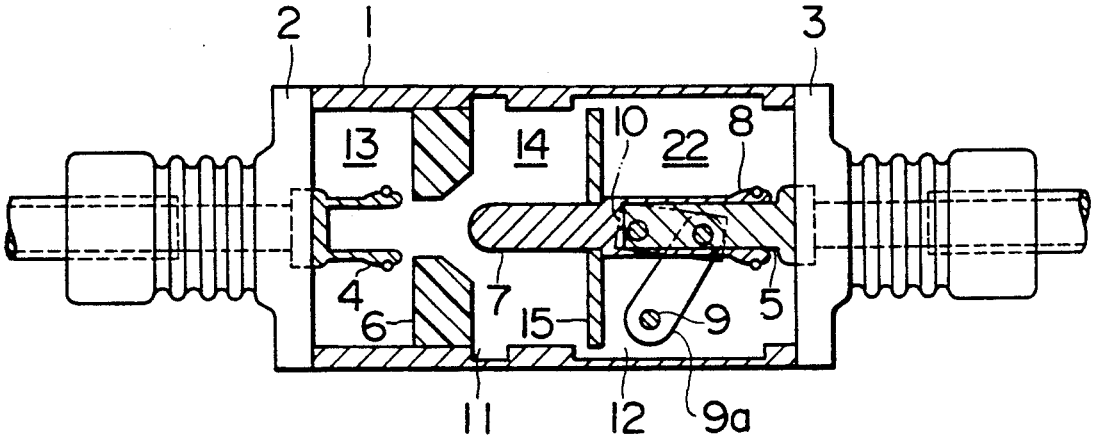

But, when the piston 15 reaches the state shown in FIG. 6, the second gas flowing means 12 communicates the suction chamber 14 and the gas chamber 22 so as to make the pressurized gas in the suction chamber 14 flow into the gas chamber 22, to thereby form a gas flow which enables an extinguishing of the arc. The second gas flowing means 12 leading to the gas chamber 22 is formed between the inner surface of the sealed container 1 of the cut-off breaker and the outer periphery of the piston 15, so that the gas flow flowing into the gas chamber 22 is directed toward the cut-off direction of the movable contact 7 and at the same time, it also enables the space of the gas chamber 22 for gas blasting, which volume has not yet been utilized. Then, the heated gas flows into the gas chamber 22 and lowers its temperature by the gas chamber 22 which has a larger volume than that of the pressure storage chamber 13 and the suction chamber 14, to thereby maintain the insulation. The terminal end position of the movable contact 7 during breaking operation is preset by a stopper which is arranged such that the proximal end or the right end portion of the movable contact 7 abuts against the distal end or the left end portion of the fixed conductor 5. Consequently, even when the excessive pressure which exerts force applied against the piston 15 causes it toward the right direction to be acted over a predetermined stroke, the current collector 8 will not be broken as in the case of the conventional type and also, the structure of the invention is simpler than that of an exclusive stopper of the conventional breaker.

Figure 2:
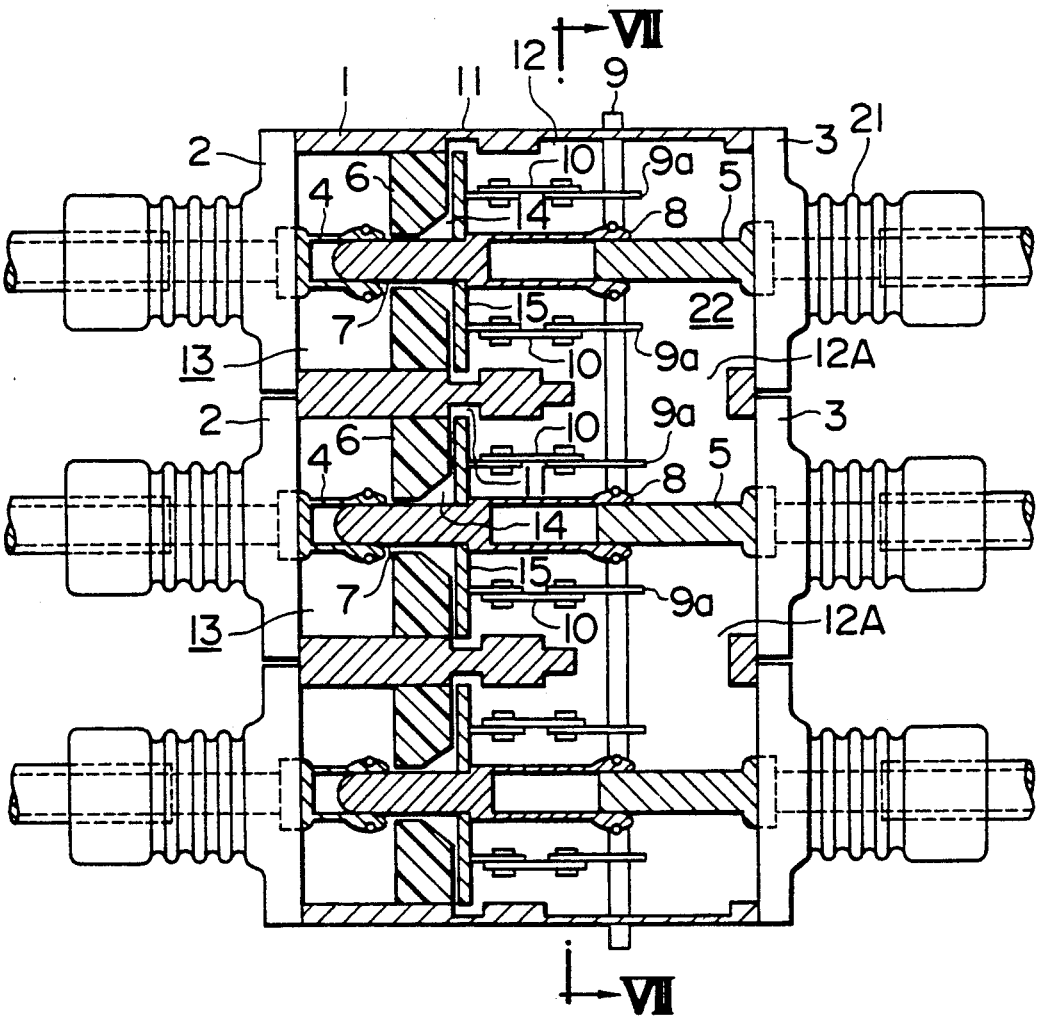
FIG. 2 is a horizontally cross-sectional plan view showing a three-phase cut-off breakers in a triple type gas-blast load-break switch which makes use of a principle of the cut-off breaker of FIG. 1.

As shown in FIG. 2, each partition wall between the neighboring cut-off breakers or at the separation location of each phase, a through hole 12A for mutually communicating adjacent gas chambers 22 is provided, which serves to lighten the weight of the breaker. In the construction at FIG. 2, as with FIG. 1, each of second gas flowing means 12 restricts gas flow in a direction of the breaking operation of a movable contact 7 so as to make it flow into the large volume gas chamber 22, whereby the high temperature gas is rapidly lowered, to thereby regulate the gas pressure in a range permissible for establishing the favorable insulation, as well as to obtain substantially the same effect as the abovementioned first embodiment.

Figure 7:
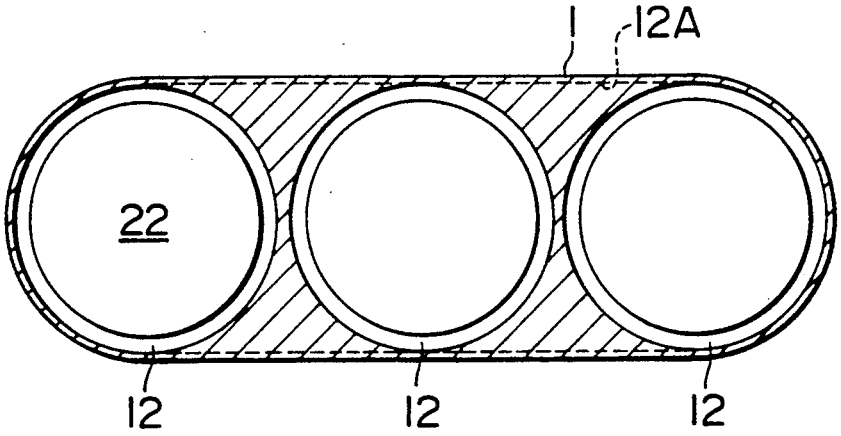
FIG. 7 is a cross-sectional view of a second gas flowing means, taken along a line VII—VII of FIG. 2.
Figure 8:
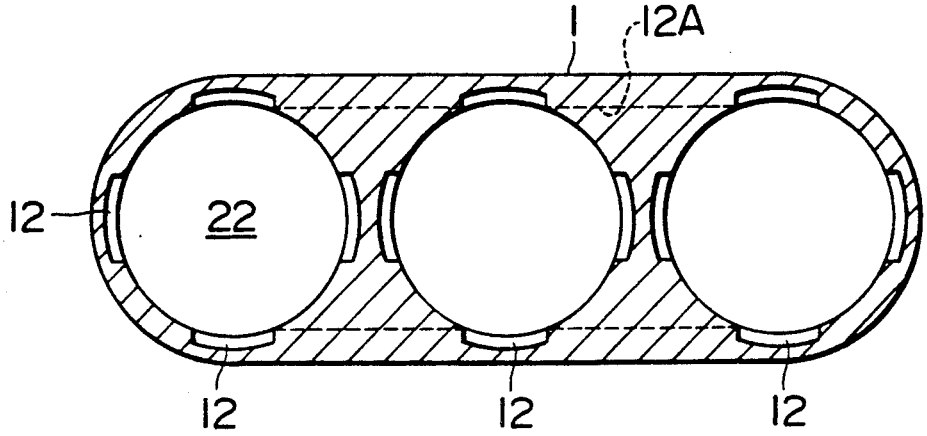
FIG. 8 is a cross-sectional view showing a modified structure of the second gas flowing means shown in FIG. 7.

According to the embodiment of FIG. 7, a recess is formed all around the inner surface of the sealed container 1 of the cut-off breaker. Alternately, there also can be provided, as shown in FIG. 8, a spline type second gas flowing means 12 comprising a plurality of recesses which are formed on the inner peripheral surface of the sealed container 1 and spaced apart from one another. In this connection, so long as the enlarged gas flow area required when the higher electric current has to be cut off is obtained, its configuration and number is not limited.

Figure 9:
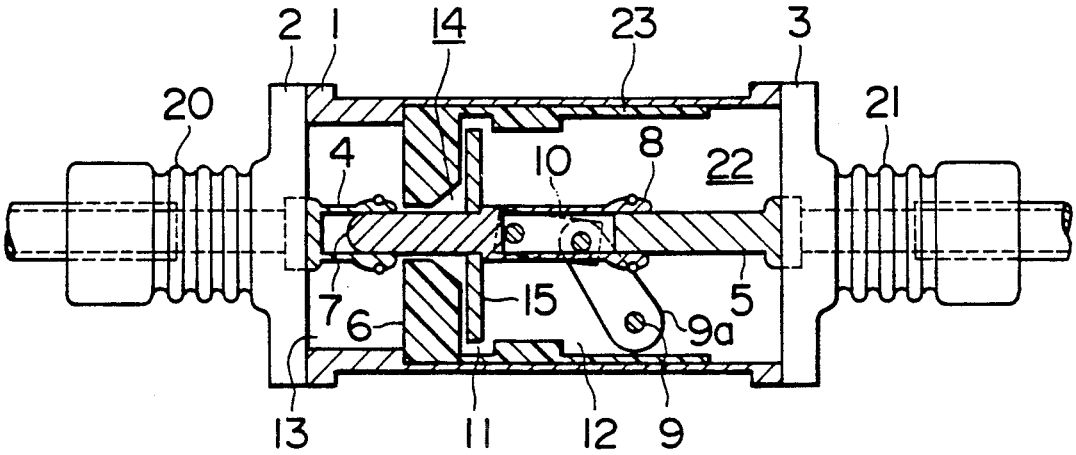
FIGS. 9 and 10 are vertically cross-sectional views illustrating cut-off breakers of gas-blast load-break switches according to further embodiments of the present invention.

Comparing with the embodiment of FIG. 1, the embodiment of FIG. 9 differs from the first embodiment with respect to the first and second gas flowing means 11, 12. According to the embodiment of FIG. 9; a portion exposed to high temperature gas which may contribute to extinguishing the arc is formed of an insulating material having an insulating nozzle 6 integral therewith. Particularly, an insulating cylinder 23 integrally formed with the insulating nozzle 6 is attached on the inner surface of the sealed container 1 of the cut-off breaker, with the first and the second gas flowing means 11, 12 being provided by defining recesses on the inner surface of this insulating cylinder.

According to this embodiment, even when the sealed container 1 of the cut-off breaker is made of metal, an insulation capacity between the high-tension arc section such as both contacts 4, 7 and the sealed container 1 of the cut-off breaker can favorably be maintained.

Figure 10:
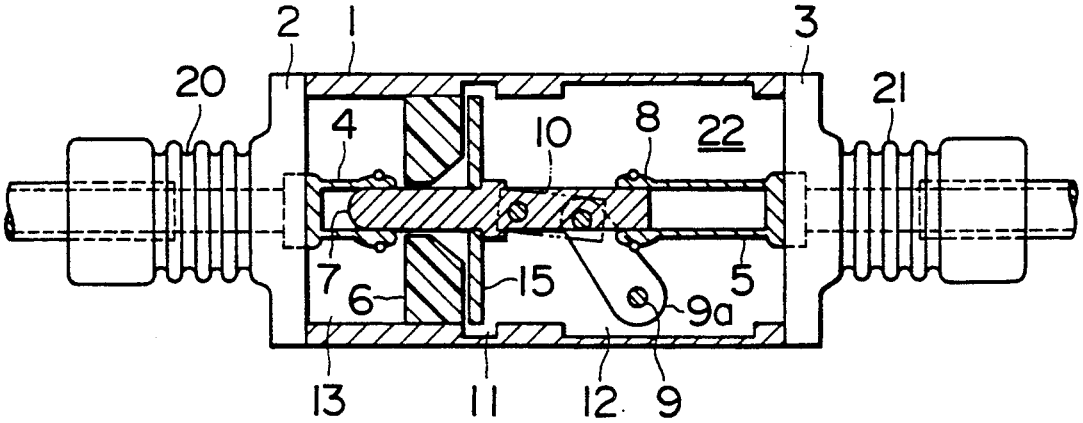

The difference between the embodiment of FIG. 10 and the embodiment of FIG. 1 resides on the arrangement of the stopper which serves to ensure electrical contact between a movable contact 7 and a fixed conductor 5 and to protect the movable contact 7 from overrunning. That is to say, the stopper is arranged in such a manner that a current collector 8 is attached on the left end of the fixed conductor 5 which is securely mounted on a central conductor of a bushing 21 in order that the right end of the movable contact 7 is to be inserted into the groove portion of the fixed conductor 5.

In the embodiment of FIG. 10, similar to the first embodiment of FIG. 1, an overstroke of the movable contact 7 can be prevented in a simple manner.

As is described above, according to the present invention, the second gas flowing means is defined between the inner surface of the sealed container of the cut-off breaker and the outer periphery of the piston adjacent the suction chamber. After a movable contact is separated from the fixed contact and a certain period of time is expired, the second gas flowing means enables communication between the suction chamber and the gas chamber, which is located on the other side of the suction chamber from the piston, whereby the rising pressure caused by the arc energy can be stored in the pressure storage chamber, which rising energy is applied to the arc for the reliable extinguishment of the arc. Further, the volume of the gas chamber is larger than that of the pressure storage chamber and the suction chamber so that the temperature of the heated gas flowing into the gas chamber can be promptly cooled, to thereby to maintain its insulation capacity.

What is claimed is:

1. A gas-blast load-break switch comprising:

a sealed container filled with arc extinguishing gas;

a fixed contact and a movable contact separable from each other, said fixed and movable contacts being disposed within said sealed container;

a pressure storage chamber including an insulating nozzle with a throat portion through which said movable contact is inserted and containing therein a contact portion between said fixed and movable contacts;

a suction chamber formed on the opposite side of said insulating nozzle from the pressure storage chamber and including a piston connected to said movable contact;

a space forming a housing for an operation lever for driving said movable contact and also a gas chamber, on the opposite side of the piston from the suction chamber within said sealed container, a volume of said gas chamber being greater than a volume of the pressure storage chamber and the suction chamber; and a gas flowing means for communicating said suction chamber and said gas chamber and interrupting the communication between said suction chamber and said gas chamber during movement of said piston, said gas flowing means being provided on an inner surface of said sealed container adjacent to said suction chamber, and wherein a length of said piston movement in said suction chamber is longer than a contact length when said movable contact is brought into contact with said fixed contact.

2. A gas-blast load-break switch according to claim 1, wherein the sealed container includes three-phase cut-off breakers, each of said breakers including a fixed contact and a movable contact separable from each other, a pressure storage chamber including an insulating nozzle with a throat portion through which said movable contact is inserted, a suction chamber formed at an opposite side of said insulating nozzle from said pressure storage chamber and including a piston connected to said movable contact, a space forming a housing for an operation layer for driving said movable contact and a gas chamber disposed on a side of the respective pistons opposite the respective suction chambers, and wherein said gas flowing means includes through holes for mutually communicating adjacent gas chambers.

3. A gas-blast load-break switch according to claim 1, wherein said suction chamber is formed such that an outer peripheral surface of said piston is brought into sliding contact with an inner peripheral surface of said sealed container when the piston moves, and wherein said gas flowing means comprises an enlarged section on the inner peripheral surface of said sealed container, said enlarged section being formed by axially spaced recessed portions provided in an inner peripheral surface of said sealed container.

4. A gas-blast load-break switch according to claim 1, wherein an insulating cylinder is disposed on an inner peripheral surface of said sealed container, said suction chamber is formed such that an outer peripheral surface of said piston is brought into sliding contact with the inner peripheral surface of said insulating cylinder along a sliding contact portion, and wherein said gas flowing means is defined on the sliding contact portion of said insulating cylinder and said piston.

5. A gas-blast load-break switch according to claim 1, wherein said sealed container includes a pair of terminal end plates disposed in opposition to each other, the fixed contact is securely fixed on one of the terminal end plates and is coaxially disposed in alignment with respect to said movable contact, a grooved portion is defined on either one of the facing portions of said fixed contact and said movable contact so as to enable the other facing portion to be slidably fitted into said grooved portion, and wherein a terminal end portion of said moved contact is regulated at said contact portion between said fixed contact and said movable contact.

6. A gas-blast load-break switch according to claim 4, wherein said space houses said sliding contact portion.

7. A gas-blast load-break switch according to claim 1, wherein said suction chamber is formed such that an outer peripheral surface of said piston is brought into sliding contact with an inner peripheral surface of said sealed container, and wherein said gas flowing means is defined on the a portion of said inner peripheral surface of said sealed container which is in contact with the piston.

* * * * *